US012805683B2

(12) United States Patent
Hu et al.

(10) Patent No.: US 12,805,683 B2
(45) Date of Patent: Nov. 24, 2026

(54) CLEANING ROBOT

(71) Applicant: Beijing Roborock Technology Co., Ltd., Beijing (CN)

(72) Inventors: Caiyun Hu, Beijing (CN); Youcheng Lu, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 421 days.

(21) Appl. No.: 18/259,291

(22) PCT Filed: Dec. 22, 2021

(86) PCT No.: PCT/CN2021/140557
§ 371 (c)(1),
(2) Date: Jun. 26, 2023

(87) PCT Pub. No.: WO2022/135489
PCT Pub. Date: Jun. 30, 2022

(65) Prior Publication Data

US 2024/0306874 A1 Sep. 19, 2024

(30) Foreign Application Priority Data

Dec. 25, 2020 (CN) ..... 202011565416.X

(51) Int. Cl.
*A47L 9/32* (2006.01)
*A47L 11/40* (2006.01)

(52) U.S. Cl.
CPC ..... *A47L 9/32* (2013.01); *A47L 11/4013* (2013.01); *A47L 2201/00* (2013.01)

(58) Field of Classification Search
CPC ..... A47L 9/32; A47L 11/4013; A47L 2201/00
See application file for complete search history.

(56) References Cited

U.S. PATENT DOCUMENTS

2013/0061417 A1* 3/2013 Vanderstegen-Drake ..... A47L 5/30 15/319
2015/0128996 A1* 5/2015 Dooley ..... A47L 11/4083 15/98

(Continued)

FOREIGN PATENT DOCUMENTS

CN 1380467 A 11/2002
CN 102987983 A 3/2013

(Continued)

OTHER PUBLICATIONS

CN-210810851-U—English Machine Translation (Year: 2020).*

(Continued)

*Primary Examiner* — Marc Carlson
(74) *Attorney, Agent, or Firm* — Perilla Knox & Hildebrandt; Kenneth A. Knox

(57) ABSTRACT

The present disclosure relates to the field of robot technologies and provides a cleaning robot. The cleaning robot includes a robot body, a cleaning device, a collecting device, and a lifting device. The cleaning device is disposed at the bottom of the robot body, and configured to remove, by interfering with a surface to be cleaned, debris from the surface to be cleaned. The collecting device is disposed in the robot body, and includes an inlet through which the debris removed by the cleaning device from the surface to be cleaned enters the collecting device. The lifting device is rotatably disposed on the robot body and configured to lift up the robot body. The inlet is tilted upwards or is perpendicular to ground when the robot body is lifted up by the lifting device.

18 Claims, 6 Drawing Sheets

(56) References Cited

U.S. PATENT DOCUMENTS

| | | | | |
|---|---|---|---|---|
| 2016/0236343 | A1* | 8/2016 | Neumann | A47L 9/2857 |
| 2017/0367554 | A1* | 12/2017 | Neumann | A47L 11/4025 |
| 2020/0383549 | A1* | 12/2020 | Weigel | A47L 11/4061 |
| 2021/0338029 | A1* | 11/2021 | Xie | B08B 3/024 |
| 2022/0079406 | A1* | 3/2022 | Zhang | A47L 11/4036 |
| 2022/0408989 | A1* | 12/2022 | Thackery | A47L 9/0045 |

FOREIGN PATENT DOCUMENTS

| | | | | | |
|---|---|---|---|---|---|
| CN | 203468508 | U | | 3/2014 | |
| CN | 105078362 | A | | 11/2015 | |
| CN | 205379259 | U | | 7/2016 | |
| CN | 206080323 | U | | 4/2017 | |
| CN | 106660591 | A | | 5/2017 | |
| CN | 207055439 | U | | 3/2018 | |
| CN | 107997685 | A | | 5/2018 | |
| CN | 209222838 | U | | 8/2019 | |
| CN | 210810851 | U | * | 6/2020 | |
| CN | 214549266 | U | | 11/2021 | |
| EP | 2753225 | B1 | | 7/2018 | |
| EP | 3505035 | A1 | | 7/2019 | |
| EP | 3256368 | B1 | | 9/2019 | |
| FR | 2857843 | A1 | * | 1/2005 | A47L 5/30 |
| JP | 2017113078 | A | | 6/2017 | |
| JP | 2022514931 | A | * | 2/2022 | G05D 1/247 |
| KR | 20130107642 | A | * | 10/2013 | A47L 9/2847 |
| KR | 102441027 | B1 | * | 9/2022 | A47L 11/204 |
| TW | 202118437 | A | * | 5/2021 | |

OTHER PUBLICATIONS

International Search Report for International Application No. PCT/CN2021/140557 mailed Mar. 16, 2022.

First Office Action for CN Patent Application No. 202011565416.X of Dec. 16, 2024.

Extended European Search Report for EP Patent Application No. 21909484.4 of Mar. 6, 2025.

First Office Action for CN Patent Application No. 2025110536051 of Jul. 15, 2026.

* cited by examiner

CLEANING ROBOT

CROSS-REFERENCE TO RELATED APPLICATION

This application is a 35 U.S.C. 371 national phase application of International Application No. PCT/CN2021/140557 filed on Dec. 22, 2021, which claims the benefit of and priority to Chinese Patent Application No. 202011565416.X, filed on Dec. 25, 2020, both of which are incorporated herein by reference in their entireties as a part of the present disclosure.

TECHNICAL FIELD

The present disclosure relates to the field of robot technologies and, in particular, to a cleaning robot.

BACKGROUND

A cleaning robot is a robot that automatically cleans a certain area to be cleaned without being operated by a user. However, when the cleaning robot is ready to work or completes its work, it often needs to be carried by the user.

SUMMARY

The present disclosure provides a cleaning robot that is convenient to carry.

The present disclosure provides a cleaning robot. The cleaning robot includes a robot body, a cleaning device, a collecting device, and a lifting device, wherein the cleaning device is disposed at the bottom of the robot body, and configured to remove, by interfering with a surface to be cleaned, debris from the surface to be cleaned; the collecting device is disposed in the robot body, and includes an inlet through which the debris removed by the cleaning device from the surface to be cleaned enters the collecting device; the lifting device is rotatably disposed on the robot body and configured to lift up the robot body; and the inlet is tilted upwards or is perpendicular to the ground when the cleaning robot is lifted up by the lifting device.

In an embodiment of the present disclosure, the lifting device is disposed at the top of the robot body.

In an embodiment of the present disclosure, the lifting device is disposed in front of the collecting device along a forward cleaning direction of the robot body.

In an embodiment of the present disclosure, the lifting device is configured to rotate by a preset angle relative to the robot body, and the preset angle is an acute angle.

In an embodiment of the present disclosure, the robot body is provided with a limiting part, and the limiting part is configured to be in limiting contact with the lifting device to limit a rotation angle of the lifting device relative to the robot body.

In an embodiment of the present disclosure, the lifting device includes a main body part; and a connecting shaft disposed on the main body part and rotatably disposed on the robot body.

In an embodiment of the present disclosure, the main body part is of an arc-shaped structure, the connecting shafts are provided in pairs, and the two connecting shafts are disposed at two ends of the main body part respectively such that the main body part is rotatably disposed relative to the robot body by the two connecting shafts.

In an embodiment of the present disclosure, the connecting shaft is disposed on a side of the main body part facing the robot body, the robot body is provided with a clamping groove, and the connecting shaft is rotatably disposed in the clamping groove.

In an embodiment of the present disclosure, the robot body is provided with a hook and a limiting bulge between which the clamping groove is formed.

In an embodiment of the present disclosure, the connecting shaft and the main body part are integrally formed.

In an embodiment of the present disclosure, the main body part includes: a plate body on which the connecting shaft is disposed; and a reinforcing rib disposed on a side of the plate body facing the robot body.

In an embodiment of the present disclosure, there is a plurality of interlaced reinforcing ribs.

In an embodiment of the present disclosure, the robot body is provided with an accommodating groove, and the lifting device is configured to rotate into the accommodating groove.

In an embodiment of the present disclosure, the accommodating groove is adapted to mate with the lifting device such that an upper surface of the lifting device is higher than an end port of the accommodating groove when the lifting device is accommodated in the accommodating groove.

In an embodiment of the present disclosure, the limiting part includes a protrusion or an elastic member.

In an embodiment of the present disclosure, the robot body (10) is provided with an accommodating groove (11); the lifting device (20) is configured to rotate into the accommodating groove (11); the limiting part includes at least one of a first limiting part and a second limiting part, wherein the first limiting part is configured to limit, by being in contact with a lower end of the lifting device, a rotation angle of the lifting device (20) relative to the robot body (10) outside the accommodating groove; and the second limiting part is configured to limit, by being in contact with an upper end of the lifting device, a rotation angle of the lifting device (20) relative to the robot body (10) inside the accommodating groove.

In an embodiment of the present disclosure, the cleaning robot further includes a power assembly pneumatically connected to the collecting device and configured to suck the debris removed from the surface to be cleaned into the collecting device.

In an embodiment of the present disclosure, the power assembly includes a fan.

In an embodiment of the present disclosure, the cleaning robot further includes a driving mechanism connected to the lifting device in a driving manner and configured to drive the lifting device to rotate relative to the robot body.

In an embodiment of the present disclosure, the driving mechanism includes a motor, an oil cylinder, or an air cylinder.

In the cleaning robot according to the embodiments of the present disclosure, the debris on the surface to be cleaned can be removed by means of the cleaning device and the collecting device that are disposed on the robot body; and the cleaning robot can be lifted up by the lifting device disposed on the robot body, such that it is convenient to carry the cleaning robot.

BRIEF DESCRIPTION OF THE DRAWINGS

The accompanying drawings are merely exemplary illustrations of the present disclosure but are not necessarily drawn to scale. In the accompanying drawings, the same reference numbers denote the same or similar parts.

Figure 1:
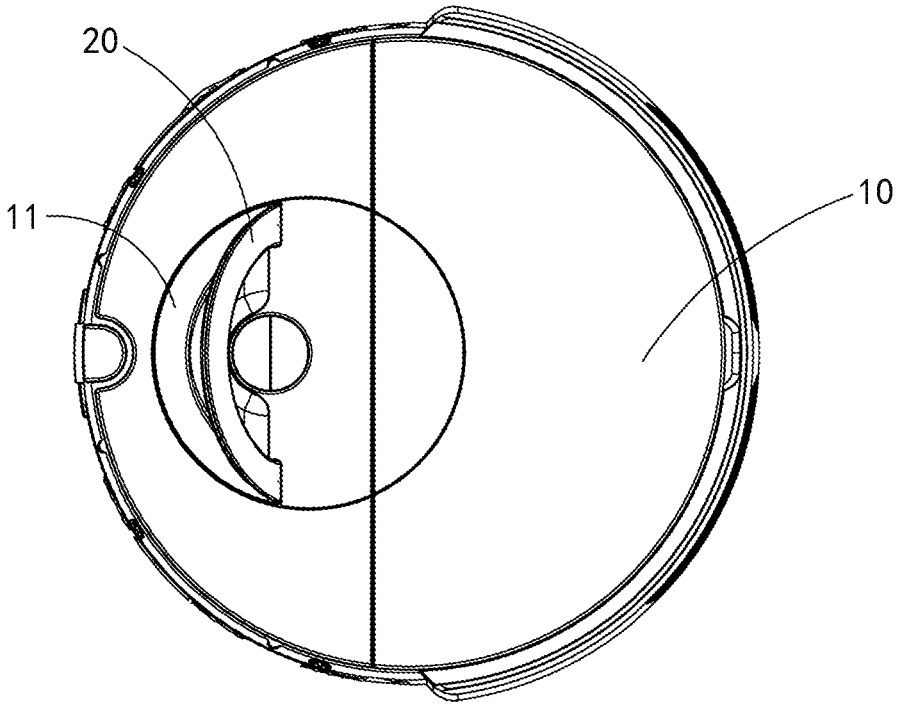
FIG. 1 is a schematic structural diagram of a cleaning robot according to an exemplary embodiment.

Reference numbers in the drawings are described as below:

10—robot body; 20—lifting device; 21—main body part; 211—plate body; 212—reinforcing rib; 22—connecting shaft; 11—accommodating groove; 12—clamping groove; 13—hook; 14—limiting bulge; 15—first limiting part; 16—second limiting part; 30—collecting device; 31—inlet; 40—cleaning device; and 50—power assembly.

DETAILED DESCRIPTION

Some embodiments that embody the features and advantages of the present disclosure will be described in detail in the following description. It should be understood that the present disclosure can have various variations on different embodiments without departing from the scope of the present disclosure, and the description and drawings therein are for the purpose of illustration only, rather than limiting the present disclosure.

Different exemplary embodiments of the present disclosure will be described below with reference to the accompanying drawings, which form a part of the present disclosure and which show, by way of example, different exemplary structures, systems and steps that may implement various aspects of the present disclosure. It should be understood that other specific solutions of components, structures, exemplary devices, systems, and steps are available, and that structural and functional modifications may be made without departing from the scope of the present disclosure. Further, although the terms "above", "between", "within", etc. may be used in the description to describe different exemplary features and elements of the present disclosure, these terms are used herein for convenience only, for example, based on the orientations of the examples in the accompanying drawings. Nothing in the present disclosure should be construed as requiring a particular three-dimensional orientation of the structure to fall within the scope of the present disclosure.

An embodiment of the present disclosure provides a cleaning robot. Referring to FIGS. 1 to 6, the cleaning robot includes a robot body 10, a cleaning device 40, a collecting device 30, and a lifting device 20.

The cleaning device 40 is disposed at the bottom of the robot body 10 and is configured to remove, by interfering with a surface to be cleaned, debris from the surface to be cleaned.

The collecting device 30 is disposed in the robot body 10 and includes an inlet 31 through which the debris removed by the cleaning device 40 from the surface to be cleaned enters the collecting device 30.

The lifting device 20 is rotatably disposed on the robot body 10 and is configured to lift up the robot body 10. The inlet 31 is tilted upwards or is perpendicular to the ground in a status in which the cleaning robot is lifted up by the lifting device 20.

In the cleaning robot according to the embodiment of the present disclosure, the debris on the surface to be cleaned can be removed by means of the cleaning device 40 and the collecting device 30 that are disposed on the robot body 10. Further, the cleaning robot can be lifted up by the lifting device 20 disposed on the robot body 10, such that it is convenient to carry the cleaning robot.

Figure 2:
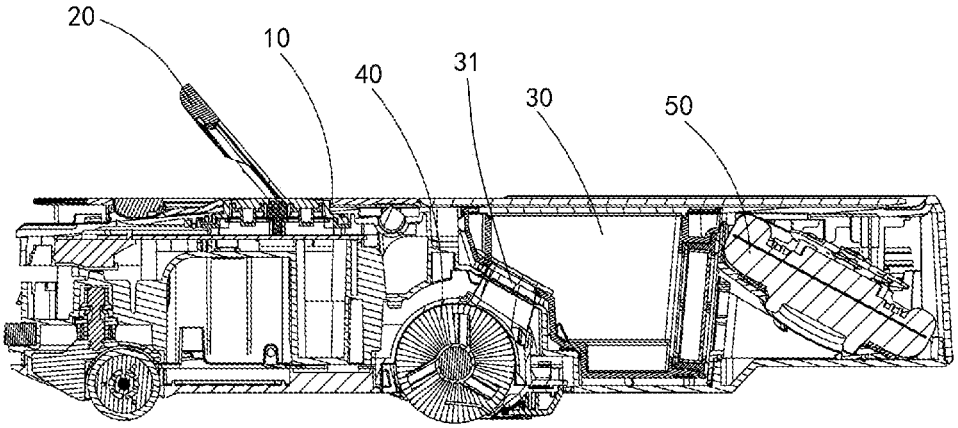
FIG. 2 is a schematic sectional structural view of the cleaning robot according to the exemplary embodiment.

In an embodiment, as shown in FIG. 2, the collecting device 30 includes an accommodating cavity, that is, the collecting device 30 may be a dust box. The inlet 31 of the collecting device 30 may be located behind the cleaning device 40 in a movement direction of the cleaning robot. For example, the collecting device 30 may be located behind the inlet 31 and interlaced with the inlet such that the collecting device 30 may be in pneumatic communication with the cleaning device 40 and can receive the debris removed by the cleaning device 40 from the surface to be cleaned.

As shown in FIG. 2, the cleaning robot further includes a power assembly 50 in pneumatic communication with the collecting device 30. In order to prevent the debris collected in the collecting device 30 from entering the power assembly 50, a filtering device may be disposed between the collecting device 30 and the power assembly 50. For example, the filtering device, such as a filter screen and filter cotton, may be disposed at an outlet of the collecting device 30. Since the power assembly 50 is in pneumatic communication with the collecting device 30 by the filtering device, negative pressure is produced among the cleaning device 40, the collecting device 30, and the power assembly 50 to suck debris on the surface to be cleaned into the collecting device 30 through the inlet 31. Optionally, the power assembly 50 is placed in the robot body 10 and may be located in any direction of the collecting device 30. For example, the power assembly 50 may be located behind the collecting device 30. The power assembly 50 may be a fan, such as a vortex-flow fan or an axial-flow fan.

In an embodiment, the cleaning device 40 includes at least one of a sweeping member and a mopping member. The cleaning robot may be configured to clean the ground, glass, or other surfaces, which will not be limited herein.

It should be noted that a user lifts up the cleaning robot by grasping the lifting device 20. When lifted up normally, the lifting device 20 is installed in such a way that the inlet 31 is tilted upwards or is perpendicular to the ground, i.e., to ensure that the inlet 31 will not be tilted downwards, thereby preventing the debris from falling out of the collecting device 30.

The inlet 31 being perpendicular to the ground may be that of a plane where the inlet 31 is located is perpendicular to the ground such that, e.g., the inlet 31 will not be tilted.

In some embodiments, the cleaning robot has a center of gravity, and the cleaning robot is divided into two parts by taking the center of gravity as a center. That is, the cleaning robot is divided into two parts along a forward cleaning direction of the cleaning robot. The lifting device 20 may be disposed on a first part or a second part of the cleaning robot. The cleaning robot will be tilted when lifted up by the lifting device 20 and, at this time, upward tilting of the inlet 31 is ensured.

Alternatively, the lifting device 20 may be disposed centrally between the first part and the second part of the cleaning robot, namely, the cleaning robot will not be tilted (in a left-right balanced status) when lifted up by the lifting device 20 and, at this time, the inlet 31 is perpendicular to the ground.

Figure 3:
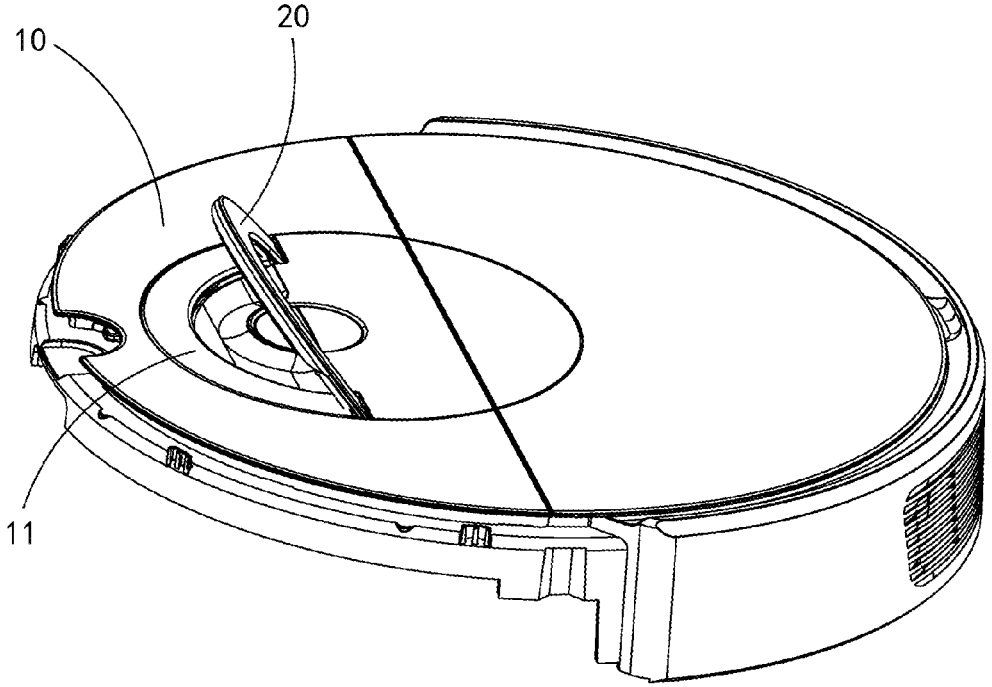
FIG. 3 is a schematic structural diagram of a part of the cleaning robot according to the exemplary embodiment.
Figure 4:
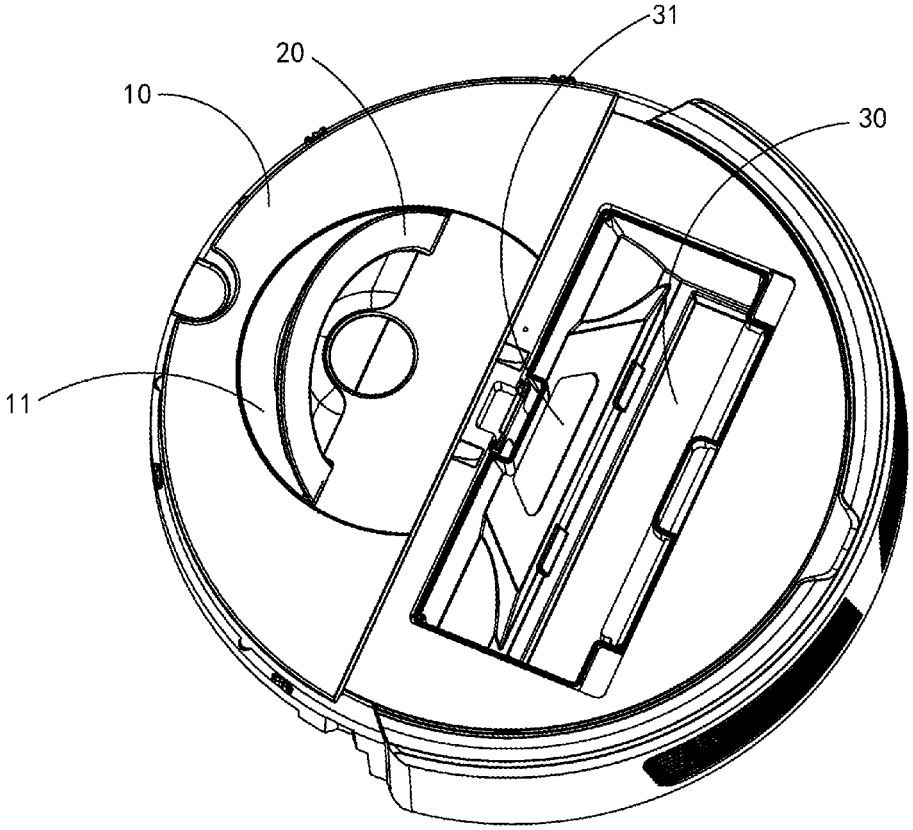
FIG. 4 is a schematic diagram of an internal structure of the cleaning robot according to the exemplary embodiment.

In an embodiment, as shown in FIGS. 1, 3, and 4, the robot body 10 is provided with an accommodating groove 11, and the lifting device 20 is configured to rotate into the accommodating groove 11. When in use, the lifting device 20 rotates relative to the robot body 10, that is, the lifting device 20 is at least partially separated from the accommodating groove 11, such that the user may grasp the lifting device 20. When not in use, the lifting device 20 may rotate into the accommodating groove 11 relative to the robot body 10, that is, the lifting device 20 is accommodated in the accommodating groove 11, such that interference between the lifting device 20 and external structures in a cleaning space may be prevented.

It should be noted that the lifting device 20 may be driven manually to rotate relative to the robot body 10. Alternatively, the cleaning robot may include a driving mechanism, and the driving mechanism is connected to the lifting device 20 in a driving manner so as to drive the lifting device 20 to rotate relative to the robot body 10. The driving mechanism may be a motor that is connected to the lifting device 20 to drive the lifting device 20 to rotate, or the driving mechanism may be an oil cylinder or an air cylinder that drives the lifting device 20 by a telescopic movement of a piston rod. The driving mechanism may be operated by a control unit so as to complete the rotation of the lifting device 20 out of the accommodating groove 11 or into the accommodating groove 11. In other embodiments of the present disclosure, the user may control the lifting device 20 to rotate relative to the robot body 10 by inputting a control instruction on a remote control apparatus. In an embodiment, the accommodating groove 11 is adapted to mate with the lifting device 20 such that an upper surface of the lifting device 20 is higher than an end port of the accommodating groove 11 when the lifting device 20 is accommodated in the accommodating groove 11, providing convenience for the user to apply an external force to the lifting device 20 so as to drive the lifting device 20 to rotate out of the accommodating groove 11.

In an embodiment, the accommodating groove 11 is adapted to mate with the lifting device 20 such that the upper surface of the lifting device 20 is flush with the end port of the accommodating groove 11 or the upper surface of the lifting device 20 is lower than the end port of the accommodating groove 11 when the lifting device 20 is accommodated in the accommodating groove 11. At this time, the lifting device 20 or the accommodating groove 11 may be provided with a notch such that the user may touch the lifting device 20 through the notch and thus apply an external force to the lifting device 20. Alternatively, the lifting device 20 may be provided with a protrusion, providing convenience for the user to apply an external force to the lifting device 20 by the protrusion. The protrusion may be a pull ring and other structures.

In an embodiment of the present disclosure, the lifting device 20 is configured to rotate by a preset angle relative to the robot body 10. The preset angle may be an acute angle. Therefore, it is convenient for the user to grasp the lifting device 20, and the lifting device 20 may not sway from side to side in the process of grasping.

In an embodiment, the robot body 10 may also be provided with a limiting part, and the limiting part is configured to be in limiting contact with the lifting device 20 to limit a rotation angle of the lifting device 20 relative to the robot body 10, e.g., to ensure that the maximum angle by which the lifting device 20 may rotate relative to the robot body 10 is an acute angle. By providing the limiting part, it can be further ensured that the cleaning robot cannot rotate by a large angle when the user lifts up the cleaning robot by the lifting device 20, such that the inlet 31 of the collecting device 30 of the cleaning robot may not be tilted downwards. Hence, the debris in the collecting device 30 is prevented from falling out from the inlet 31.

It should be noted that the limiting part may be a protrusion, e.g., the lifting device 20 is in limiting contact with the protrusion after rotating by the maximum angle, thereby ensuring that the lifting device 20 may not further rotate. Alternatively, the limiting part may be an elastic member, e.g., the elastic member may be compressed when the lifting device 20 rotates relative to the robot body 10.

Figure 8:
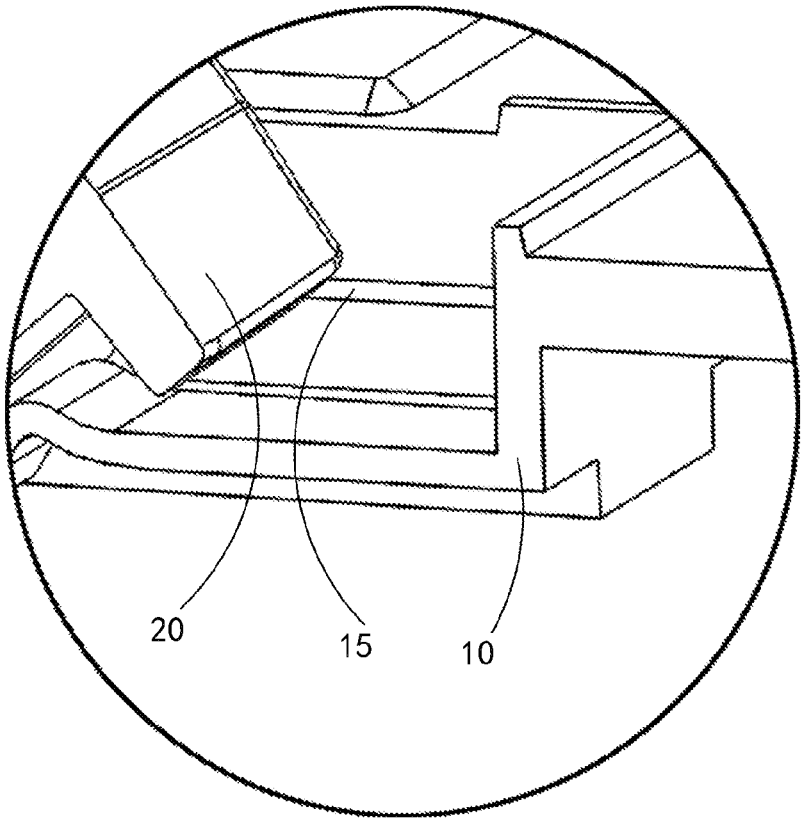
FIG. 8 is a second partial schematic structural diagram of the cleaning robot according to the exemplary embodiment.

In an embodiment, as shown in FIG. 8, the limiting part includes a first limiting part 15, and a lower end of the lifting device 20 may be in contact with the first limiting part 15 after the lifting device 20 rotates out of the accommodating groove 11 by a certain angle, such that the lifting device 20 is prevented from further rotation. The first limiting part 15 may be a plane, e.g., the lifting device 20 cannot continue to rotate after the first limiting part 15 comes into contact with an end part of the lifting device 20.

Figure 9:
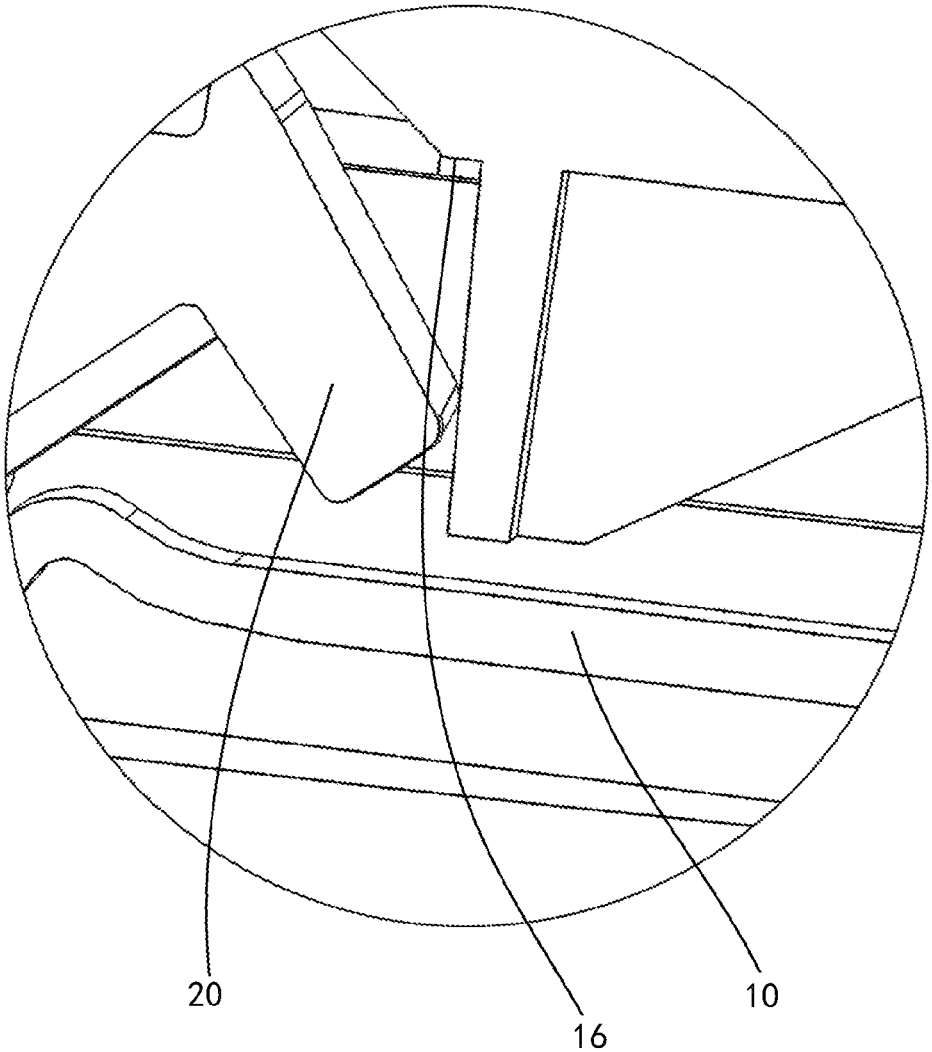
FIG. 9 is a third partial schematic structural diagram of the cleaning robot according to the exemplary embodiment.

In an embodiment, as shown in FIG. 9, the limiting part includes a second limiting part 16, and an upper end of the lifting device 20 may be in contact with the second limiting part 16 after the lifting device 20 rotates into the accommodating groove 11, e.g., the lifting device 20 rotates in place. The second limiting part 16 may be a plane, e.g., the lifting device 20 rotates in place after the second limiting part 16 comes into contact with the end part of the lifting device 20.

In an embodiment of the present disclosure, the lifting device 20 is disposed at the top of the robot body 10, e.g., the user lifts up the cleaning robot by the top of the robot body 10.

In some embodiments, the lifting device 20 may be disposed on a side of the robot body 10, so that the cleaning robot can be lifted up conveniently, but it should be ensured that the inlet 31 is tilted upward or perpendicular to the ground when the cleaning robot is lifted up by the lifting device 20.

In an embodiment, an angle is formed between the lifting device 20 and the robot body 10 after the lifting device 20 rotates relative to the robot body 10 by a preset angle. The direction, along which the inlet 31 is away from the collecting device 30 is the same as the direction of an opening of the angle, is such that the debris in the collecting device 30 may not flow out from the inlet 31 when the user obliquely lifts up the robot body 10, e.g., the inlet 31 is tilted upwards.

With reference to FIG. 4, in the movement direction of the cleaning robot, an opening of the angle formed between the lifting device 20 and the robot body 10 faces the front of the cleaning robot after the lifting device 20 rotates relative to the robot body 10 by the maximum angle, and the inlet 31 of the collecting device 30 is formed in the front of the collecting device 30. e.g., the inlet 31 also faces the front of the cleaning robot. Since the angle between the lifting device 20 and the robot body 10 is an acute angle and the opening of this angle faces the front of the cleaning robot, the user's fingers may be inserted from the rear to the left side of the lifting device 20 to tightly hold the lifting device 20 when the user grasps the lifting device 20. Therefore, the inlet 31 may face upwards when the lifting device 20 is lifted up, which prevents the debris in the collecting device 30 from flowing out from the inlet 31.

In an embodiment, the collecting device 30 and the cleaning device 40 are arranged sequentially along the forward cleaning direction of the robot body 10, e.g., the lifting device 20 is disposed in front of the collecting device 30 along the forward cleaning direction of the robot body 10.

Optionally, the lifting device 20 is located above the cleaning device 40, e.g., the collecting device 30, the cleaning device 40, and the lifting device 20 are arranged sequentially along the forward cleaning direction of the robot body 10. The cleaning device 40 is located at the lower part of the robot body 10, the cleaning device 40 is located in the middle of the robot body 10, and the lifting device 20 is located at the top of the robot body 10.

Specifically, with reference to FIGS. 1 to 4, in the movement direction of the cleaning robot, the entire robot body 10 may be divided into two parts as viewed from the top. The cleaning device 40 may be close to the front side of the robot body 10, the collecting device 30 may be located on the rear side of the robot body 10, and the lifting device 20 may be located on the front side of the robot body 10, for example. Therefore, when the user lifts up the cleaning robot, the front part of the robot body 10 is tilted upwards under the action of gravity, e.g., the inlet 31 of the collecting device 30 may face upwards, thereby ensuring that the debris in the collecting device 30 may not flow out from the inlet 31. In addition, it is unnecessary for the user to carefully ensure a lifting angle of the cleaning robot since from the point of view of facilitating lifting by the user, as the inlet 31 may be completely prevented from facing downwards.

In some embodiments, the lifting device 20 may be at least partially located right above the cleaning device 40.

Figure 5:
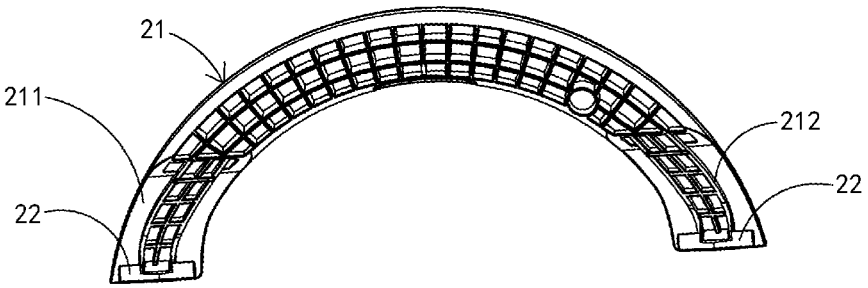
FIG. 5 is a schematic structural diagram of a cleaning device of the cleaning robot from a first perspective according to the exemplary embodiment.
Figure 6:
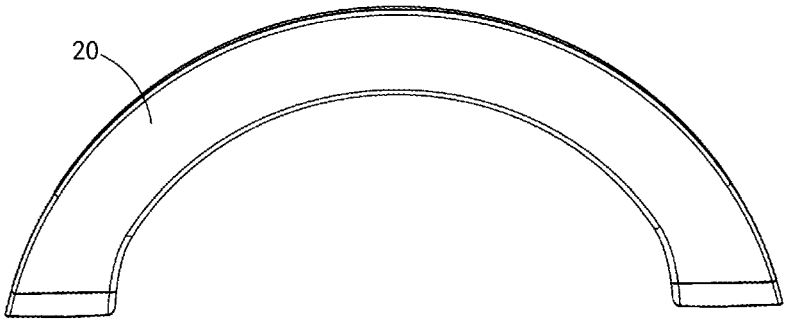
FIG. 6 is a schematic structural diagram of the cleaning device of the cleaning robot from a second perspective according to the exemplary embodiment.

In an embodiment, as shown in FIGS. 5 and 6, the lifting device 20 includes a main body part 21, and a connecting shaft 22 disposed on the main body part 21 and rotatably disposed on the robot body 10. The main body part 21 is configured to be grasped by the user, and the connecting shaft 22 may ensure reliable rotation of the lifting device 20 relative to the robot body 10.

It should be noted that the main body part 21 may be in the shape of a handle, and the connecting shaft 22 may be a protrusion and other structures as long as rotational connection between the connecting shaft 22 and the robot body 10 can be ensured.

In an embodiment, the main body part 21 may be of an arc-shaped structure, the connecting shafts 22 are provided in pairs, and the two connecting shafts 22 are disposed at two ends of the main body part 21 respectively such that the main body part 21 is rotatably disposed relative to the robot body 10 by the two connecting shafts. Thus, the reliable connection between the lifting device 20 and the robot body 10 can be ensured.

Specifically, with reference to FIGS. 5 and 6, the main body part 21 is of an arc-shaped structure as a whole, the connecting shafts 22 are connected to the two ends of the main body part 21 respectively, and the two ends of the connecting shafts 22 are inserted into the robot body 10 so as to achieve the reliable connection between the lifting device 20 and the robot body 10.

In an embodiment, as shown in FIG. 5, the connecting shaft 22 is disposed on a side of the main body part 21 facing the robot body 10, such that the connecting shaft 22 may not be seen from the outside after the lifting device 20 and the robot body 10 are connected to each other, e.g., the main body part 21 can effectively shield the connecting shaft 22.

Figure 7:
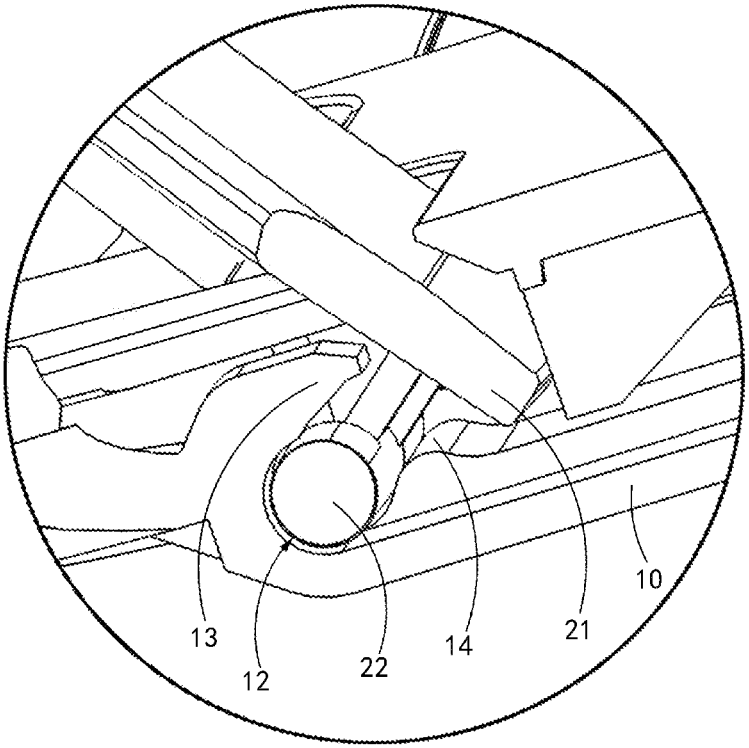
FIG. 7 is a first partial schematic structural diagram of the cleaning robot according to the exemplary embodiment.

In an embodiment, as shown in FIG. 7, the robot body 10 is provided with a clamping groove 12, and the connecting shaft 22 is rotatably disposed in the clamping groove 12. The connecting shaft 22 cooperates with the clamping groove 12 like a bulge that cooperates with a recess, not only ensuring that the connecting shaft 22 may not be separated from the robot body 10, but also ensuring that the connecting shaft 22 rotates relative to the robot body 10.

In some embodiments, the connecting shaft 22 is of a cylindrical structure, the clamping groove 12 is an open groove, and the connecting shaft 22 may be installed in the clamping groove 12 through the opening, as shown in FIG. 7.

In an embodiment, as shown in FIG. 7, the robot body 10 is provided with a hook 13 and a limiting protrusion 14 between which the clamping groove 12 is formed, e.g., the clamping groove 12 has an opening for the connecting shaft 22 to be installed into the clamping groove 12. After the connecting shaft 22 is installed into the clamping groove 12, the hook 13 and the limiting protrusion 14 limit the connecting shaft 22 in two directions to prevent the connecting shaft 22 from being separated from the clamping groove 12.

Further, the connecting shaft 22 may slightly deform. Thus, the connecting shaft 22 may slightly deform in the process of being installed into the clamping groove 12 and may restore to its original shape after being installed into the clamping groove 12. Thus, it may be prevented from being separated from the clamping groove 12. The opening direction of the clamping groove 12 is different from that of the angle formed between the main body part 21 and the robot body 10, such that there is no need to worry that the lifting device 20 may be separated from the clamping groove 12 when lifted up.

In an embodiment, the connecting shaft 22 and the main body part 21 are integrally formed, which achieves not only relatively high molding efficiency, but also high structural strength.

In some embodiments, the connecting shaft 22 and the main body part 21 may be two separate parts that are fixedly connected after being independently molded.

In an embodiment, as shown in FIG. 5, the main body part 21 includes a plate body 211 on which the connecting shaft 22 is disposed, and a reinforcing rib 212 disposed on a side of the plate body 211 facing the robot body 10. That is, the reinforcing rib 212 may not be exposed, but sufficient strength of the plate body 211 is ensured.

In an embodiment, there is a plurality of interlaced reinforcing ribs 212 to ensure relatively high strength of the main body part 21.

In an embodiment, the cleaning robot may be a sweeping robot, a mopping robot, a window-cleaning robot, a polishing robot, or the like.

Other embodiments of the present disclosure will be apparent to those skilled in the art from consideration of the description and practice of the present disclosure. The present disclosure is intended to cover any variations, uses, or adaptations of the present disclosure following the general principles of the present disclosure and including common knowledge or customary technical means in the art which are not disclosed in the present disclosure. The description and the exemplary embodiments are to be considered as exemplary only, with a true scope and spirit of the present disclosure indicated by the foregoing claims.

It should be appreciated that the present disclosure is not limited to the exact construction that has been described above and illustrated in the accompanying drawings, and that various modifications and changes can be made without departing from the scope of the present disclosure. It is intended that the scope of the present disclosure is only limited by the appended claims.

What is claimed is:

1. A cleaning robot, comprising:

a robot body;

a cleaning device disposed at a bottom of the robot body that is configured to remove, by interfering with a surface to be cleaned, debris from the surface to be cleaned;

a collecting device disposed in the robot body comprising an inlet, wherein the debris removed by the cleaning device from the surface to be cleaned enters the collecting device through the inlet; and a lifting device rotatably disposed on the robot body configured to lift up the robot body, wherein the inlet is tilted upwards or is perpendicular to a ground surface when the robot body is lifted up by the lifting device, the lifting device comprises a main body part, and the main body part comprises: a plate body and a plurality of interlaced reinforcing ribs disposed, but not exposed, on a side of the plate body facing the robot body; and a driving mechanism connected to the lifting device in a driving manner and configured to drive the lifting device to rotate relative to the robot body.

2. The cleaning robot according to claim 1, wherein the lifting device is disposed at a top of the robot body.

3. The cleaning robot according to claim 2, wherein the lifting device is disposed in front of the collecting device along a forward cleaning direction of the robot body.

4. The cleaning robot according to claim 3, wherein the lifting device is configured to rotate by a preset angle relative to the robot body, the preset angle being an acute angle.

5. The cleaning robot according to claim 4, wherein the robot body is provided with a limiting part, and the limiting part is configured to be in limiting contact with the lifting device to limit a rotation angle of the lifting device relative to the robot body.

6. The cleaning robot according to claim 5, wherein the limiting part comprises a protrusion or an elastic member.

7. The cleaning robot according to claim 5, wherein:

the robot body is provided with an accommodating groove, and the lifting device is configured to rotate into the accommodating groove;

the limiting part comprises at least one of a first limiting part and a second limiting part;

the first limiting part is configured to limit, by being in contact with a lower end of the lifting device, a rotation angle of the lifting device relative to the robot body outside the accommodating groove; and the second limiting part is configured to limit, by being in contact with an upper end of the lifting device, a rotation angle of the lifting device relative to the robot body inside the accommodating groove.

8. The cleaning robot according to claim 1, wherein the lifting device further comprises:

at least one connecting shaft, disposed on the main body part and rotatably disposed on the robot body.

9. The cleaning robot according to claim 8, wherein the main body part is of an arc-shaped structure, the at least one connecting shaft is provided in pairs, and two connecting shafts in a pair are disposed at two ends of the main body part respectively, such that the main body part is rotatably disposed relative to the robot body through the two connecting shafts.

10. The cleaning robot according to claim 9, wherein the at least one connecting shaft is disposed on a side of the main body part facing the robot body, the robot body is provided with a clamping groove, and the at least one connecting shaft is rotatably disposed in the clamping groove.

11. The cleaning robot according to claim 10, wherein the robot body is provided with a hook and a limiting bulge, and the clamping groove is formed between the hook and the limiting bulge.

12. The cleaning robot according to claim 8, wherein the at least one connecting shaft and the main body part are integrally formed.

13. The cleaning robot according to claim 8, wherein the connecting shaft is disposed on the plate body.

14. The cleaning robot according to claim 1, wherein the robot body is provided with an accommodating groove, and the lifting device is configured to rotate into the accommodating groove.

15. The cleaning robot according to claim 14, wherein the accommodating groove is adapted to mate with the lifting device, such that an upper surface of the lifting device is higher than an end port of the accommodating groove when the lifting device is accommodated in the accommodating groove.

16. The cleaning robot according to claim 1, further comprising a power assembly, pneumatically connected to the collecting device and configured to suck the debris removed from the surface to be cleaned into the collecting device.

17. The cleaning robot according to claim 16, wherein the power assembly comprises a fan.

18. The cleaning robot according to claim 1, wherein the driving mechanism comprises a motor, an oil cylinder, or an air cylinder.

* * * * *